US009631894B2

(12) United States Patent
Leslie

(10) Patent No.: US 9,631,894 B2
(45) Date of Patent: Apr. 25, 2017

(54) HEATED, REMOVABLE, BATTERY POWERED FIREARM GRIP

(71) Applicant: Jimi Leslie, San Diego, CA (US)

(72) Inventor: Jimi Leslie, San Diego, CA (US)

( * ) Notice: Subject to any disclaimer, the term of this patent is extended or adjusted under 35 U.S.C. 154(b) by 12 days.

(21) Appl. No.: 15/040,104

(22) Filed: Feb. 10, 2016

(65) Prior Publication Data

US 2016/0161213 A1 Jun. 9, 2016

Related U.S. Application Data

(63) Continuation-in-part of application No. 14/159,175, filed on Jan. 20, 2014, now Pat. No. 9,291,423.

(51) Int. Cl.

| | |
|---|---|
| ***F41C 23/16*** | (2006.01) |
| ***F41C 27/00*** | (2006.01) |
| ***H05B 3/18*** | (2006.01) |
| ***F41C 23/10*** | (2006.01) |

(52) U.S. Cl.

CPC ..... *F41C 23/16* (2013.01); *F41C 23/10* (2013.01); *F41C 27/00* (2013.01); *H05B 3/18* (2013.01); *H05B 2203/014* (2013.01); *Y10T 29/49119* (2015.01)

(58) Field of Classification Search

CPC ..... F41C 23/16; F41C 23/10
USPC ..... 42/84
See application file for complete search history.

(56) References Cited

U.S. PATENT DOCUMENTS

| | | | | | |
|---|---|---|---|---|---|
| 3,031,557 | A * | 4/1962 | Gibbs | F41C 27/00 | 219/201 |
| 3,057,342 | A * | 10/1962 | Woodzick | F41B 5/14 | 126/208 |
| 3,742,635 | A * | 7/1973 | Hutto | F41A 13/02 | 126/208 |
| 4,646,461 | A * | 3/1987 | McLeod | A01K 87/085 | 126/206 |
| 4,709,201 | A * | 11/1987 | Schaefer | H01M 10/46 | 320/112 |
| 6,164,003 | A * | 12/2000 | Miller | F41C 27/00 | 126/204 |
| 2007/0007266 | A1* | 1/2007 | Sasaki | B62J 33/00 | 219/202 |
| 2010/0275489 | A1* | 11/2010 | Cabahug | F41C 23/22 | 42/71.01 |

* cited by examiner

*Primary Examiner* — Reginald Tillman, Jr.
(74) *Attorney, Agent, or Firm* — Kevin Keener; Keener and Associates P.C.

(57) ABSTRACT

The invention is directed toward a heated grip for a firearm. The heated firearm grip comprises a grip body, and a rechargeable cartridge comprising a power source and an electrically resistive heating element. The grip body is shaped as a pistol style firearm grip and has a hollow internal cavity in the grip body. The grip body is interchangeable with the factory installed grip of a firearm. The rechargeable cartridge may have a shaped rigid outer body. The rigid shaped outer body may be configured to operate as a pistol clip. The rechargeable cartridge may be removably secured within the hollow internal cavity of the grip body. The rechargeable cartridge may be removed when a user presses a magazine release button on the grip body of the firearm.

20 Claims, 14 Drawing Sheets

HEATED, REMOVABLE, BATTERY POWERED FIREARM GRIP

PRIORITY

This application is a Continuation-in-Part, and claims priority to, U.S. patent application Ser. No. 14/159,175 filed on Jan. 20, 2014.

FIELD OF THE INVENTION

This invention relates generally to firearms and firearm components and more particularly to a system method for providing a heated firearm grip which may be interchanged between multiple receivers and firearms.

BACKGROUND OF INVENTION

Most grips simply attach to the firearm and allow the user to handle and control the weapon. In extremely cold conditions a person's hands can become cold and stiff, restricting the movement of the hands and fingers. A person needs to have smooth and steady trigger control and maximum dexterity in order to shoot a firearm accurately. While gloves on the users' hands can help provide some warmth, they also restrict movement, dexterity and sensitivity. What is needed is a heated firearm grip that allows a user to retain more heat in their hands and fingers, decreasing the restrictive movement caused from gloves and the cold environment.

U.S. Pat. No. 6,164,003 on Dec. 26, 2000 to Miller shows a heated firearm stock which requires batteries held in the stock of the firearm to provide power to heat a portion of the stock surface. The Miller patent is limited in that it the heating element is limited to the shooting hand and the Miller patent does not teach the heating of the non-shooting hand. Additionally, the Miller patent teaches that only a portion of the grip of the firearm contains a heating element instead of the entire grip of the firearm. The Miller patent also requires the use of the entire stock of the firearm instead of only the grip of the firearm. What is needed is a system and method of heating a firearm grip without use of the firearm stock and that heats the entire surface of the firearm grip. In addition, what is needed is a heated firearm grip which is removable and interchangeable between multiple firearms.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The invention is directed toward a heated firearm grip comprising a grip body and a rechargeable cartridge. The grip body has a hollow internal cavity. The grip body is shaped as a pistol style firearm grip. The rechargeable cartridge comprises a power source and an electrically resistive heating element electrically connected to the power source. The rechargeable cartridge may be connected to a recharging station to recharge the power source. The rechargeable cartridge may be removably secured within the hollow internal cavity of the grip body. The grip body is interchangeable with the factory installed grip of a firearm.

The heated firearm grip may further comprise a level switch disposed on the rechargeable cartridge, the level switch regulating the amperage of electricity flowing from the power source and through the electrically restrictive heating element. The level switch has a plurality of positions. The heated firearm grip may further comprise a power switch disposed on the rechargeable cartridge. Furthermore, the rechargeable cartridge may further comprise a rigid shaped outer body.

The outer body of the rechargeable cartridge may have a lock recess, wherein the grip body further comprises a magazine release button, wherein the rechargeable cartridge is released from the inner cavity of the grip body when the magazine release button is pressed. The rechargeable cartridge may further comprise a filler material.

The invention is also be directed toward a system for heating a handgrip of a firearm comprising a grip body, one or more rechargeable cartridges, and one or more charging stations, each one or more charging stations comprising a power cord and one or more battery receivers. The grip body has a hollow internal cavity. The grip body is shaped as a pistol style firearm grip. Each rechargeable cartridge comprises a power source and an electrically resistive heating element electrically connected to the power source. A rechargeable cartridge may be connected to a battery receiver on a recharging station to recharge the power source. Each of the one or more rechargeable cartridges may be removably secured within the hollow internal cavity of the grip body. The grip body is interchangeable with the factory installed grip of a firearm. The charging station may further comprise a pair of electrical connection points in each of the battery receivers. Each of the rechargeable cartridges may further comprise a pair of electrical connection points.

The invention is also directed toward a firearm having a heated grip comprising a grip body, a grip mount bolt, and a rechargeable cartridge. The grip body has a hollow internal cavity. The grip body is shaped as a pistol style firearm grip. The grip mount bolt passes through the hollow internal cavity of the grip body to removably secure the grip body to the firearm. The firearm may be a paintball gun or a semiautomatic rifle.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

Figure 1:
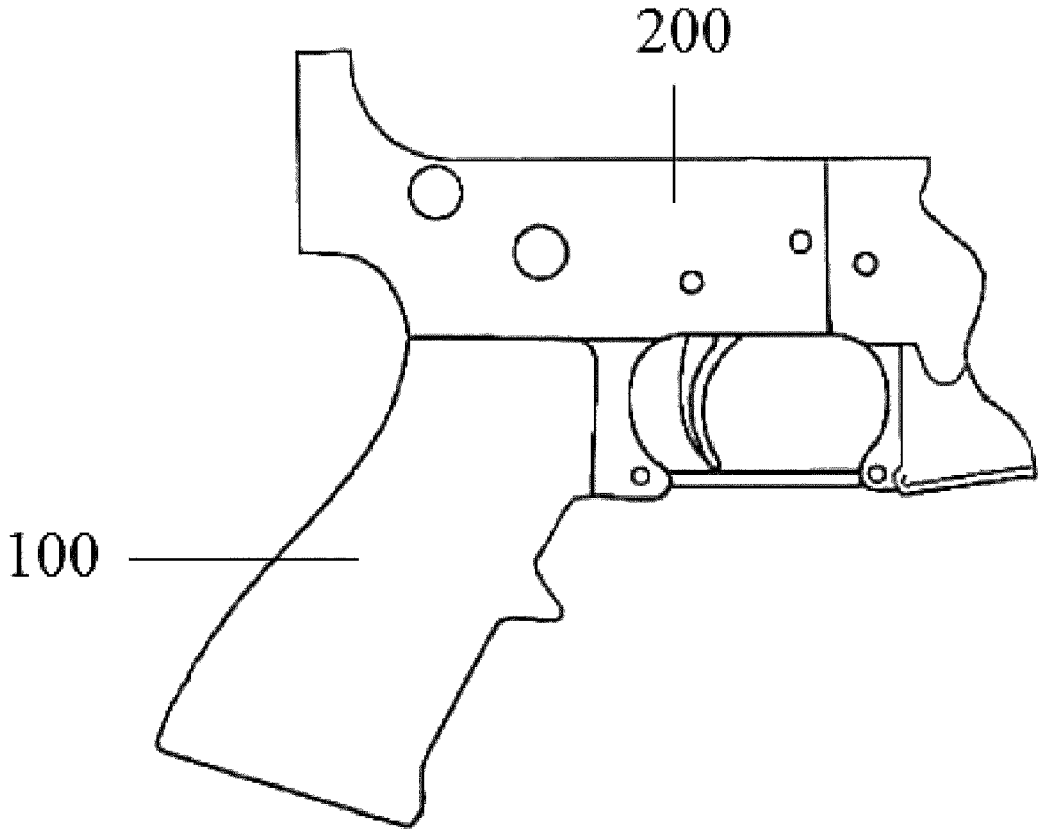
FIG. 1 is a side view of the grip installed on a firearm.

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims. Although the present invention will be described with reference to the exemplary embodiments shown in the drawings, it should be understood that the present invention can be embodied in many alternate forms or embodiments. Alternative materials and designs may be used in the alternative forms and embodiments.

Figure 2:
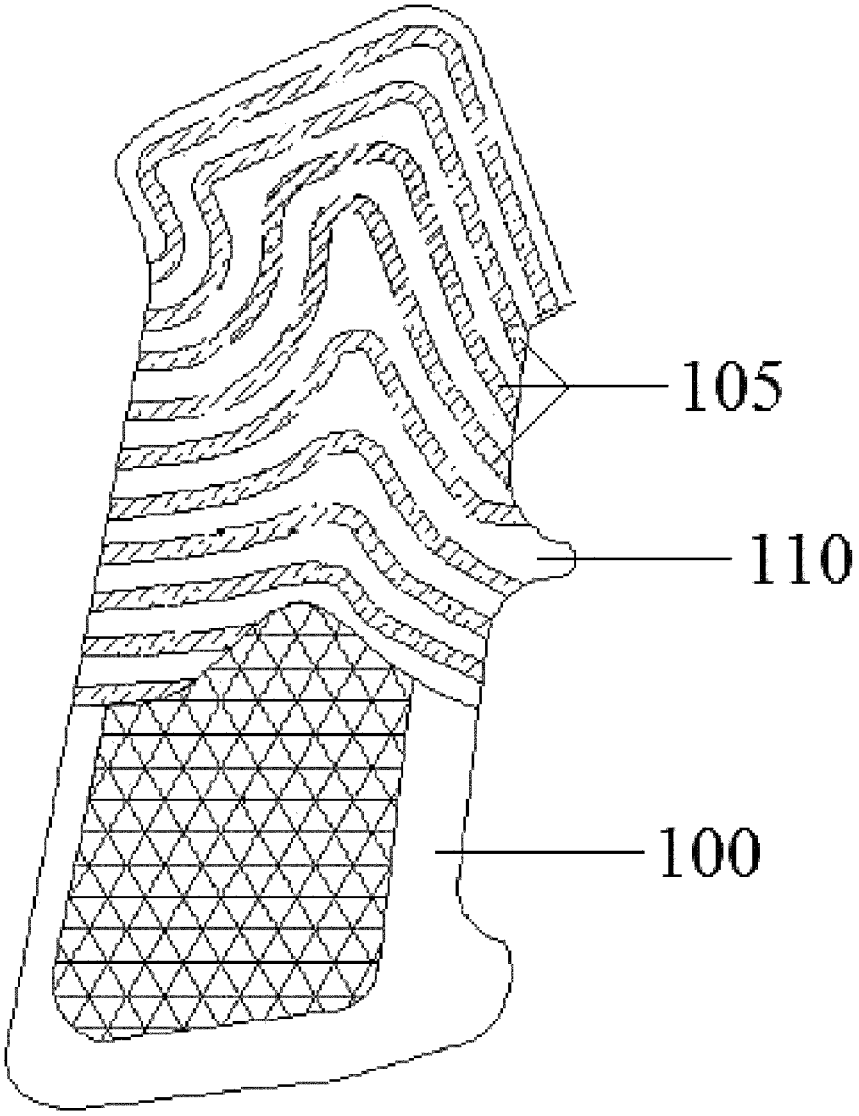
FIG. 2 is a side view of the grip with an external sleeve.

Referring to FIG. 1, the grip body 100 is attached to a firearm receiver 200. Referring to FIG. 2, one embodiment of the invention is displayed. In this embodiment the grip body 100 is covered by a polyurethane sleeve 110. Wound within the polyurethane sleeve 110 is a resistive wire 105. As electricity passes through the resistive wire 105, heat is produced. The heat passes through the polyurethane sleeve 110 to warm the hand of the user.

Figure 3:
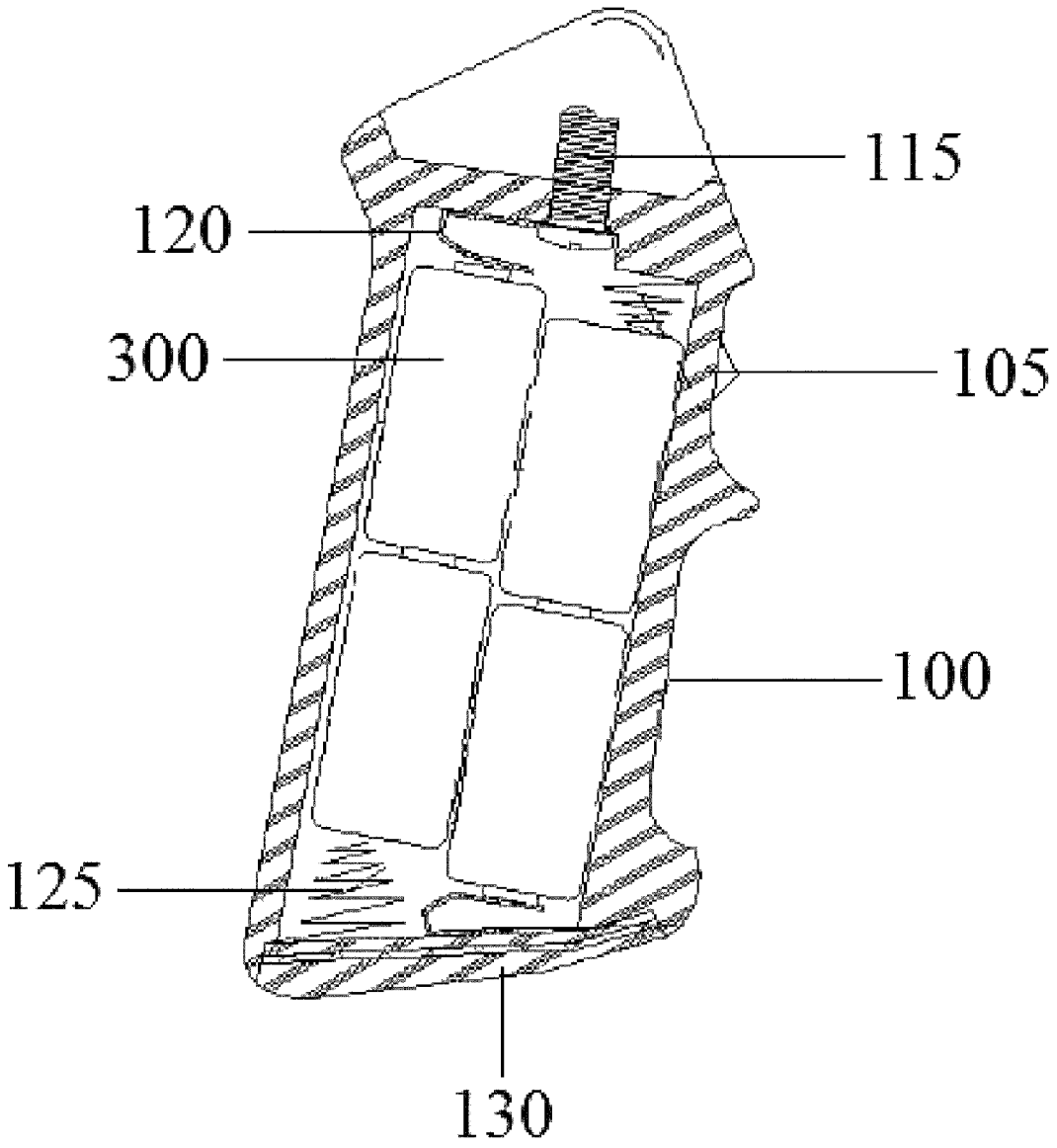
FIG. 3 is a cut away view of the grip.
Figure 4:
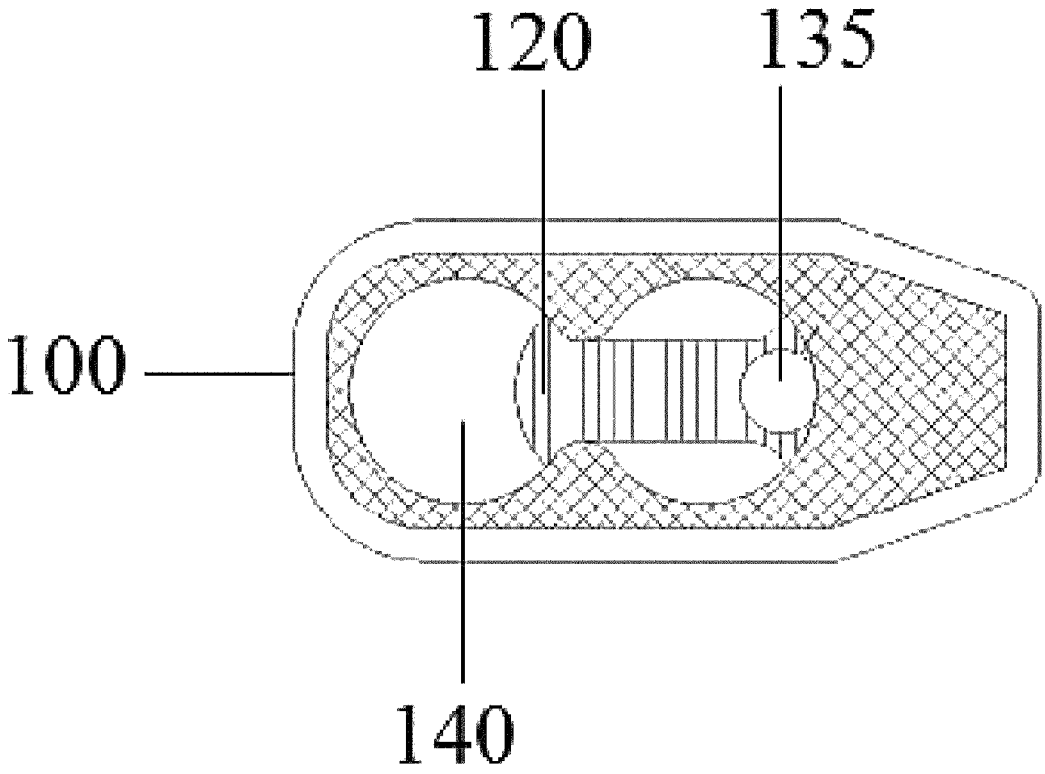
FIG. 4 is a bottom view of the grip.

Referring to FIG. 3 and FIG. 4, an alternative embodiment of the invention is displayed. In this embodiment, the resistive wire 105 is molded into the grip body 100. The grip body 100 is secured to the firearm receiver 200 by means of a grip mount bolt 115. The grip mount bolt 115 passes through the mount bolt hole 135 to removably secure the grip body 100 to the firearm receiver 200. The resistive wire 105 is powered by any number of batteries 300. The batteries are connected to the resistive wire 105 by springs 125 and contact tabs 120. The batteries 300 are held in an internal cavity 140 in the grip body 100. The batteries 300 are held in the internal cavity 140 by a bottom lid 130. The bottom lid 130 may have a spring 125 and a contact tab 120 connected to the bottom lid 130.

Figure 5:
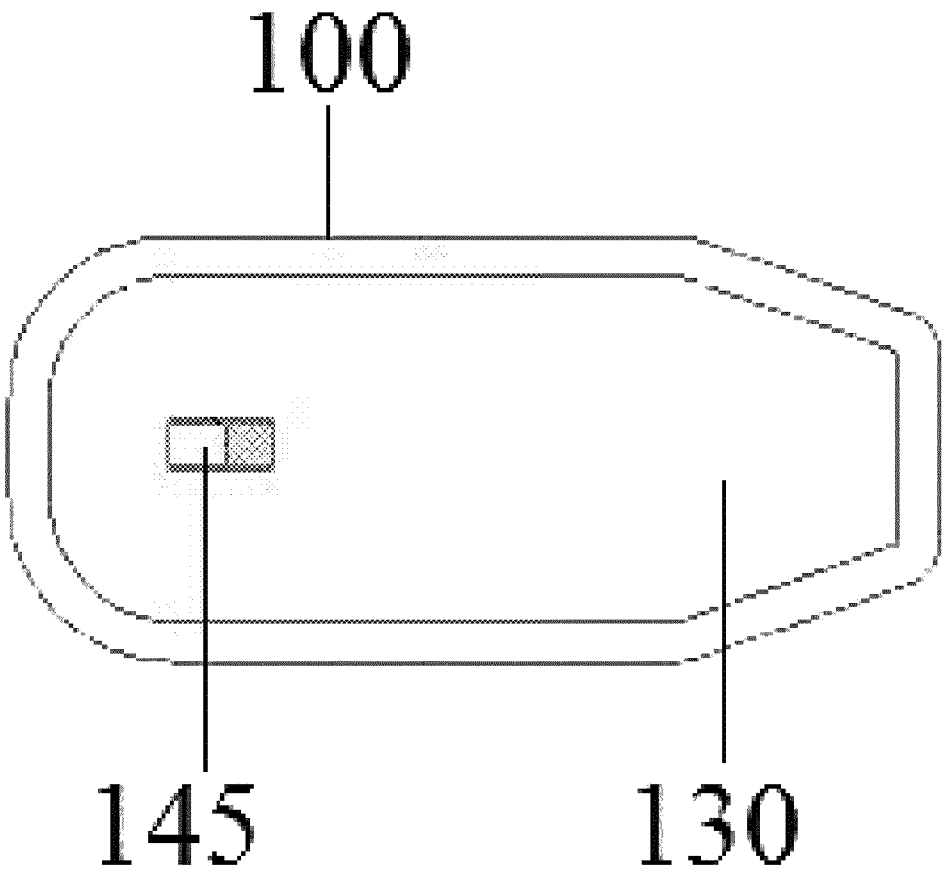
FIG. 5 is a bottom view of the grip.

Referring to FIG. 5, the bottom lid 130 has a switch 145. The switch 145 regulates the power level that runs through the resistive wire 105. The switch 145 may have any number of usable positions. The switch 145 has an "on" position and an "off" position. In the "on" position, electricity runs through the resistive wire 105 to produce heat. In the "off" position, the circuit is broken, no electricity passes through the resistive wire 105 and no heat is produced. The switch 145 may also have a "hi" position, a "medium" position, and a "low" position. These positions regulate the amount of electricity passing through the resistive wire 105 and thus the amount of heat produced by the resistive wire 105. The "hi" position allows the largest amount of electricity to pass through the resistive wire 105 and thus produce the most heat. The "low" position allows a minimal amount of electricity to pass through the resistive wire 105 and thus produce a minimum amount of heat. The "medium" position allows an amount of electricity to pass through the resistive wire 105 that is less than the amount from the "hi" position but more than the amount from the "low" position. This allows the resistive wire 105 to produce an intermediate amount of heat.

Figure 6:
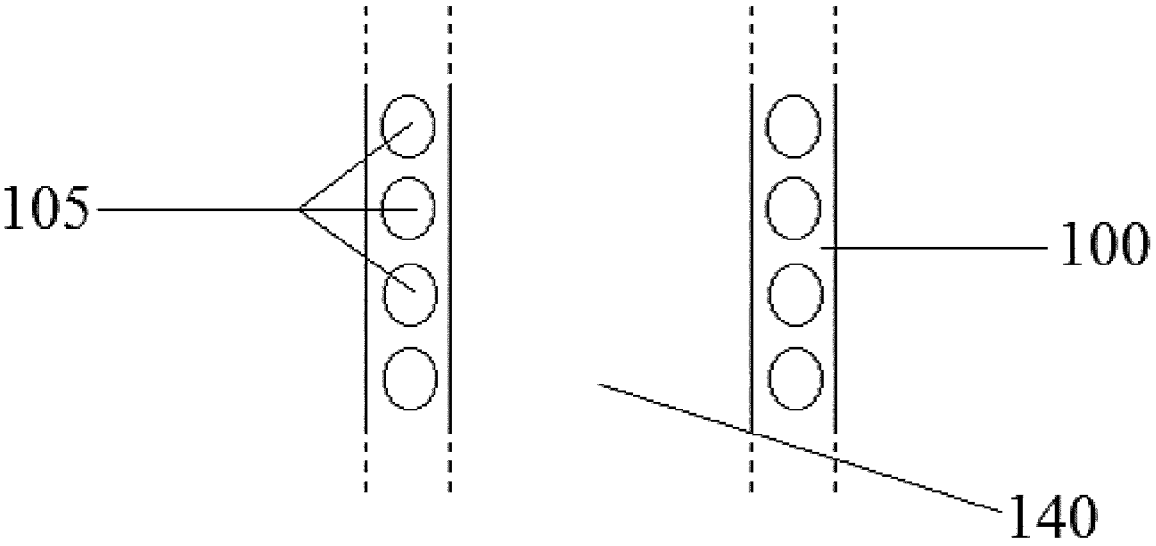
FIG. 6 is a cut away view of the grip.
Figure 7:
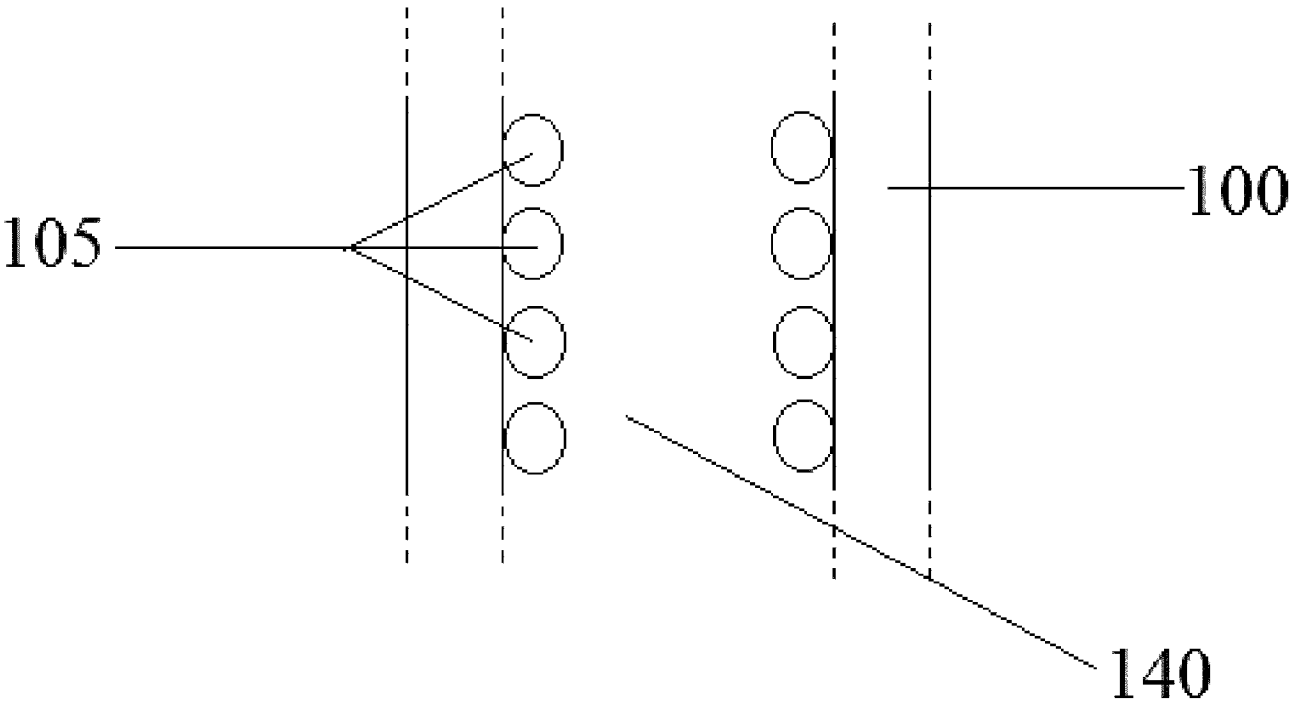
FIG. 7 is a cut away view of the grip.

Referring to FIG. 6, a close up view of the grip body 100 is displayed. In the embodiment displayed, the resistive wire 105 is molded into the grip body 100. As heat is produced by the resistive wire 105, the heat transfers into the grip body 100. Referring to FIG. 7, an alternative embodiment of the invention is displayed. In this embodiment, the resistive wire 105 is located within the internal cavity 140 of the grip body 100. In the displayed embodiment, the resistive wire 105 is in direct contact with the internal surface of the grip body 100 within the internal cavity 140.

Figure 8:
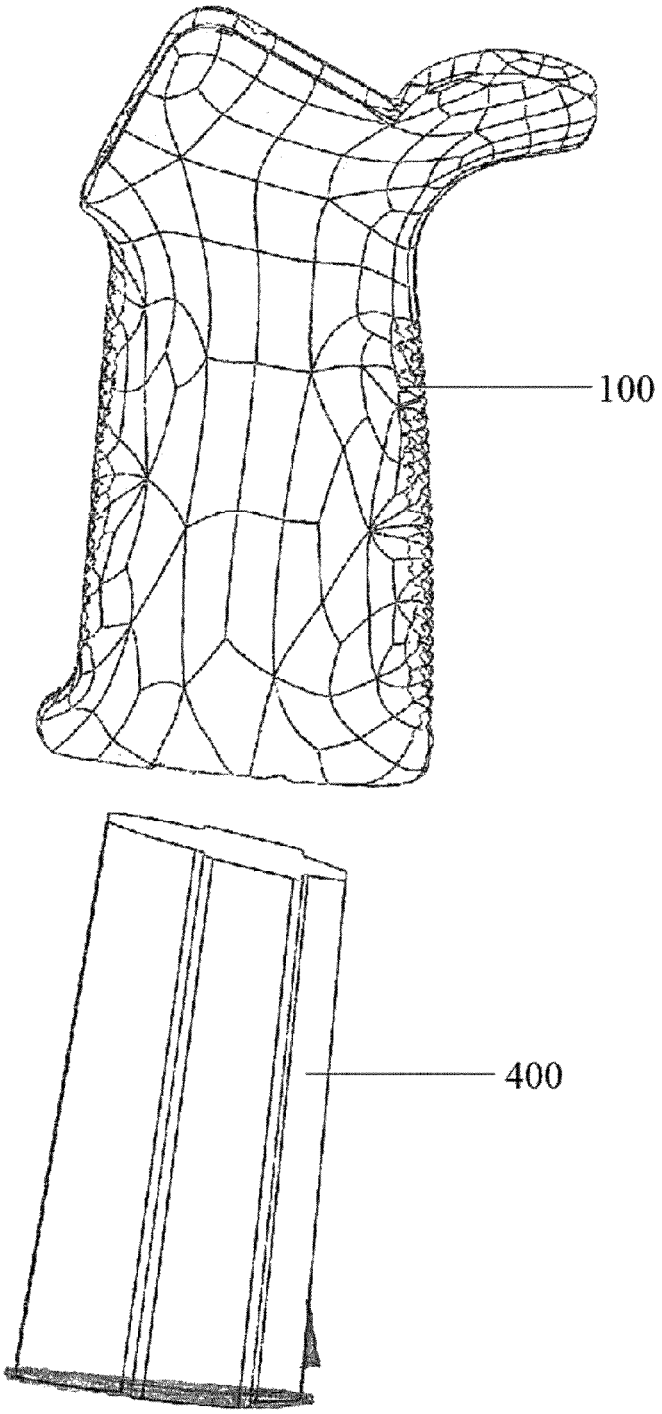
FIG. 8 is a perspective view of the grip with a rechargeable cartridge.

Referring to FIG. 8, an alternative embodiment of the invention is displayed. In this embodiment the functional components of the heating device are housed in a rechargeable cartridge 400. Within the rechargeable cartridge 400 are the resistive wire 105 and batteries 300. The rechargeable cartridge 400 can be inserted into the grip body 100. In this embodiment, the rechargeable cartridge 400 is inserted into the internal cavity 140 of the grip body 100. The rechargeable cartridge 400 may then be turned on to provide heat to the grip body 100. When not in use, a user may remove the rechargeable cartridge 400 and plug the rechargeable cartridge 400 into a charging station to recharge the batteries 300. A user may use multiple rechargeable cartridges 400. In this manner the user may use one rechargeable cartridge 400 in the grip body 100 while another rechargeable cartridge 400 is recharging its batteries 300 in a charging station.

Figure 9:
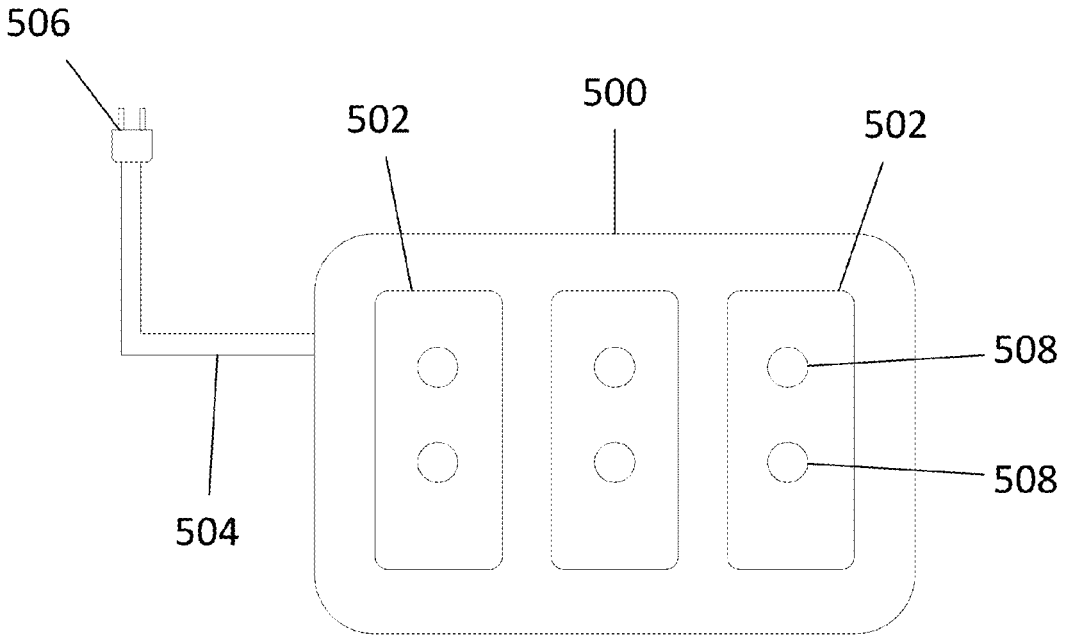
FIG. 9 is a top view of a charging station.

Referring to FIG. 9, a charging station 500 for the rechargeable cartridge 400 is displayed. The charging station 500 is has a power cord 504 extending from the charging station 500 and terminating in an outlet plug 506. The outlet plug 506 is configured to plug into a standard wall outlet to provide power to the charging station 500. The charging station 500 has one or more battery receivers 502. The charging station 500 may have any number of battery receivers 502. The battery receivers 502 are depressions configured to hold the rechargeable cartridge 400 during recharging. The battery receivers 502 may be any size and shape. In other embodiments, the battery receivers 502 may be outcroppings extending above the charging station 500. In the embodiment illustrated, within each battery receiver 502 is a pair of electrical connection points 508 which contact the rechargeable cartridge 400 to permit the flow of electricity to the rechargeable cartridge 400 to recharge the rechargeable cartridge 400. In other embodiments, the charging station 500 does not have connection points 508 and recharges the rechargeable cartridge 400 via inductive charging.

Figure 10A:
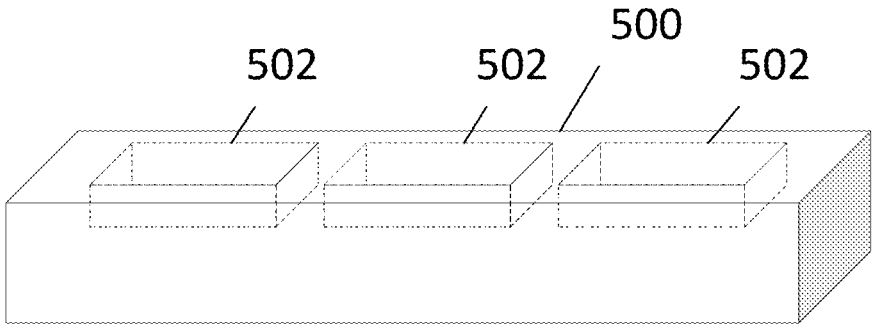
FIG. 10A is top perspective view of a charging station.
Figure 10B:
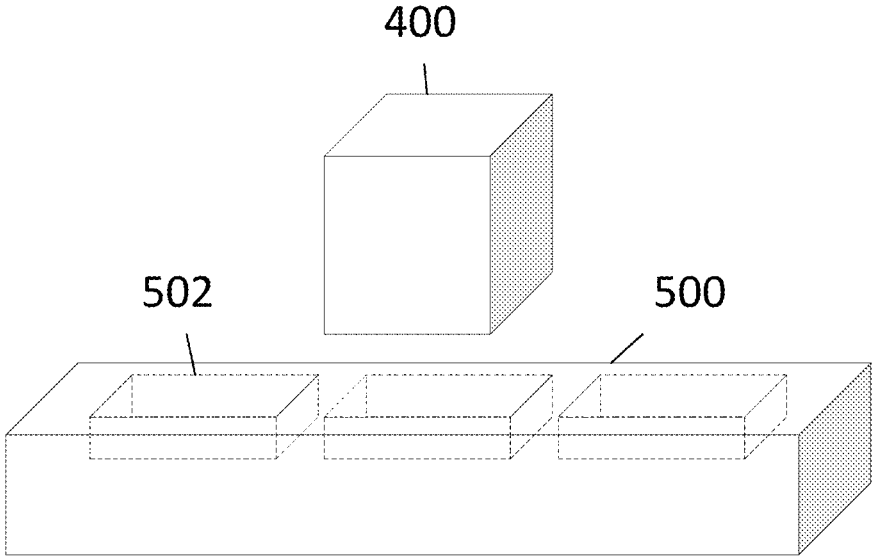
FIG. 10B is top perspective view of a charging station.
Figure 10C:
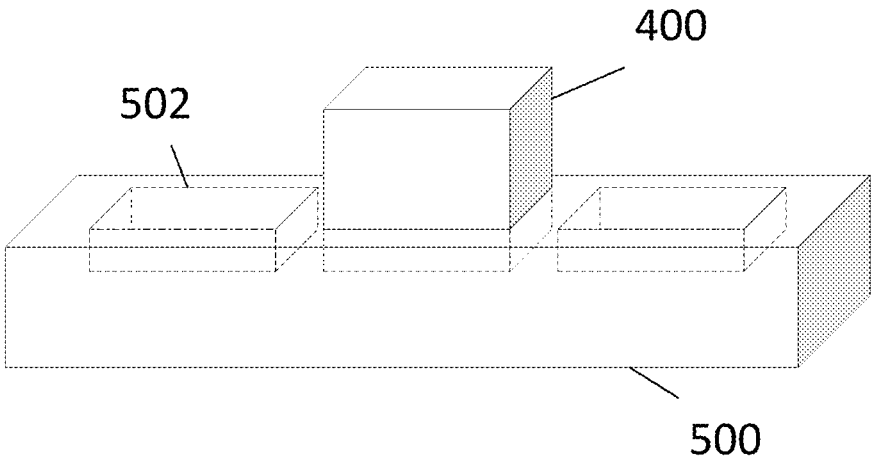
FIG. 10C is top perspective view of a charging station.
Figure 10D:
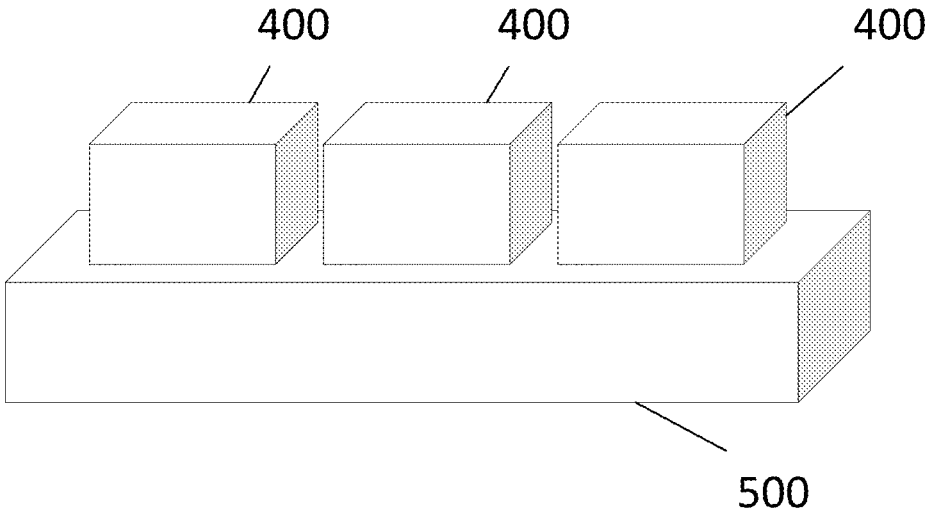
FIG. 10D is top perspective view of a charging station.

Referring to FIG. 10A through FIG. 10D, the use of the charging station 500 is illustrated. First, as shown in FIG. 10A, a charging station may set in a charging location with the battery receivers 502 empty because the rechargeable cartridges 400 are in use. When a rechargeable cartridge 400 needs to be recharged the user chooses a battery receiver 502 to place the rechargeable cartridge 400 in as in FIG. 10B. The user places the rechargeable cartridge 400 in a battery receiver 502 for recharging as in FIG. 10C. Each battery receiver 502 of the charging station 500 can hold and charge a rechargeable cartridge 400 at the same time as shown in FIG. 10D.

Figure 11:
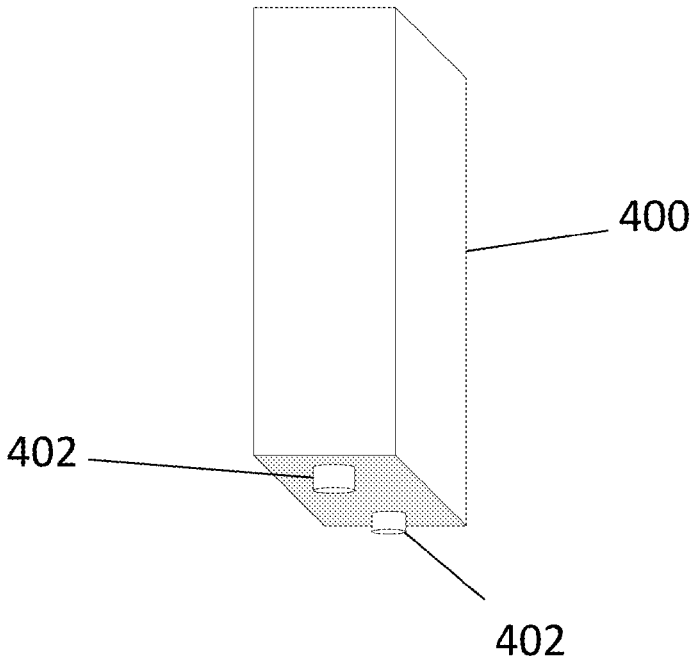
FIG. 11 is a bottom perspective view of a rechargeable cartridge.
Figure 12:
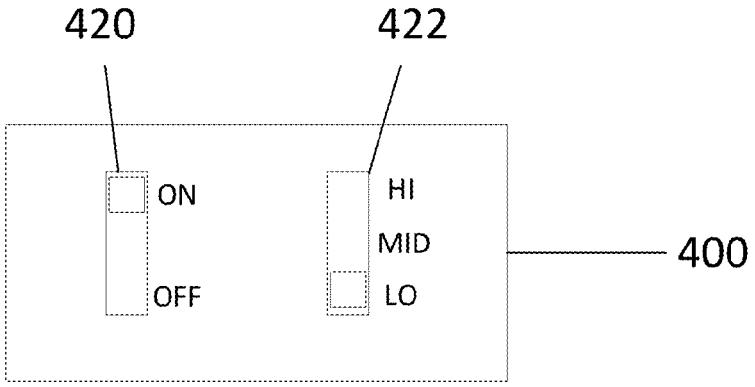
FIG. 12 is a top view of a rechargeable cartridge.

The rechargeable cartridge 400 can be made in any configuration. In one embodiment, as shown in FIG. 11, the rechargeable cartridge 400 has a pair of connection points 402 which create an electrical connection with connections points 508 of the charging station 500. In one embodiment, as illustrated in FIG. 12, the outside of the rechargeable cartridge 400 has a power switch 420 and a level switch 422. The power switch 420 permits the user to turn the rechargeable cartridge 400 on and off so that when the power switch 420 is in the "on" position the rechargeable cartridge 400 is generating heat and when in the "off" position the rechargeable cartridge 400 is not generating heat. The level switch 422 permits the user to adjust the amount of heat generated by the rechargeable cartridge 400. The level switch 422 may have any number of power levels. In the illustrated embodiment, the level switch 422 may operate at a "HI" power level which generates the most amount of heat, a "MID" power level which generates a medium amount of heat, or a "LO" power level which generates a small amount of heat. The power switch 422 may operate in any known manner to adjust the amount of heat generated by an electrical circuit. In the preferred embodiment the power switch 422 utilizes a rheostat to adjust the level of current being delivered to the heating element of the rechargeable cartridge 400.

Figure 13:
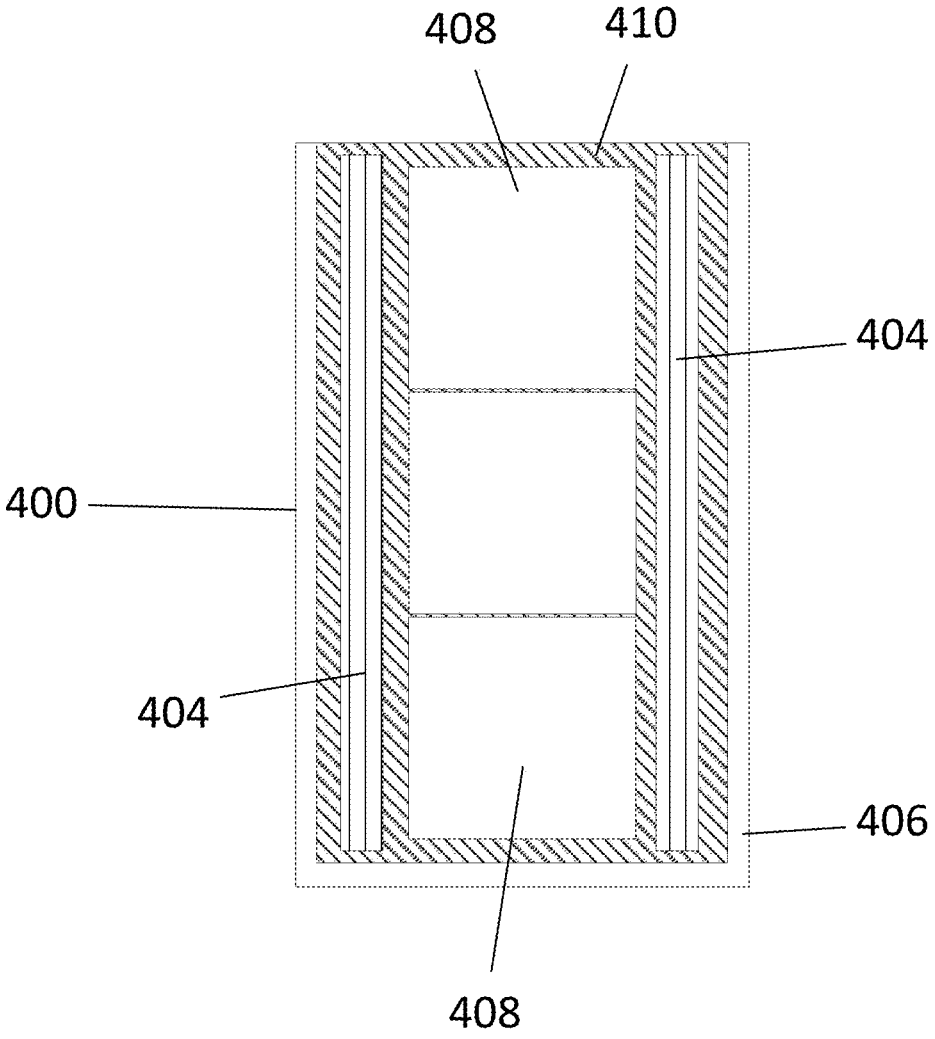
FIG. 13 is a side cut away view of a rechargeable cartridge.

Referring to FIG. 13, a cut away side view of the rechargeable cartridge 400 is illustrated. Within the internal body of the rechargeable cartridge 400 are one or more cells 408 which are in electrical connection with each other. The cells 408 may be in any location in the body of the rechargeable cartridge 400, but in the preferred embodiment are in the core of the rechargeable cartridge 400. The multiple cells 408 may be wired in series or in parallel. The rechargeable cartridge 400 has a layer formed by the resistive wire 404 which surrounds the cells 408. The resistive wire 404 is electrically connected to the cells 408. The rechargeable cartridge 400 has an outer body 406 which gives shape to the rechargeable cartridge 400 and defines the outer edge of the rechargeable cartridge 400. The outer body 406 may be any type of material. The outer body 406 may be a rigid, thick, material forming a hard body, such as a hard thermoplastic or a metal casing. Alternatively, the outer body 406 may be a thin, pliable material, such as a tight wrapping of a plastic material. In some embodiments the inner body of the rechargeable cartridge 400 may contain a filler material 410. The filler material 410 may be any type of material. In one embodiment the filler material 410 is an insulating material which operates as a blanket to slow the amount of heat loss from the rechargeable cartridge 400 when it is in use. In another embodiment the filler material 410 may be a material with a high heat capacity. In this embodiment, the resistive wire 404 quickly heats the filler material 410. When the rechargeable cartridge 400 is turned off, the filler material 410 then slowly releases its stored heat. In this way the heat is released over a longer period of time after the rechargeable cartridge 400 is turned off.

The rechargeable cartridge 400 may be inserted into the internal cavity 140 of the grip body in any manner. The rechargeable cartridge 400 may be inserted into the internal cavity 140 from an opening in the bottom of the grip body 100. A user may remove the grip body 100 from the firearm receiver 200 and insert the rechargeable cartridge 400 into an opening in the top of the grip body 100. In some embodiments there may be a special grip body 100 with a hinged opening in the side of the grip body permitting the user to insert the rechargeable cartridge 400 from the side.

In other embodiments the rechargeable cartridge 400 has a textured outer body 406 to resemble a portion of a standard grip body of a firearm. In this embodiment, the grip body 100 may have a fixed opening which is not covered until the rechargeable cartridge 400 is inserted in to the grip body 100 to fill the fixed opening and complete the handle.

Figure 14:
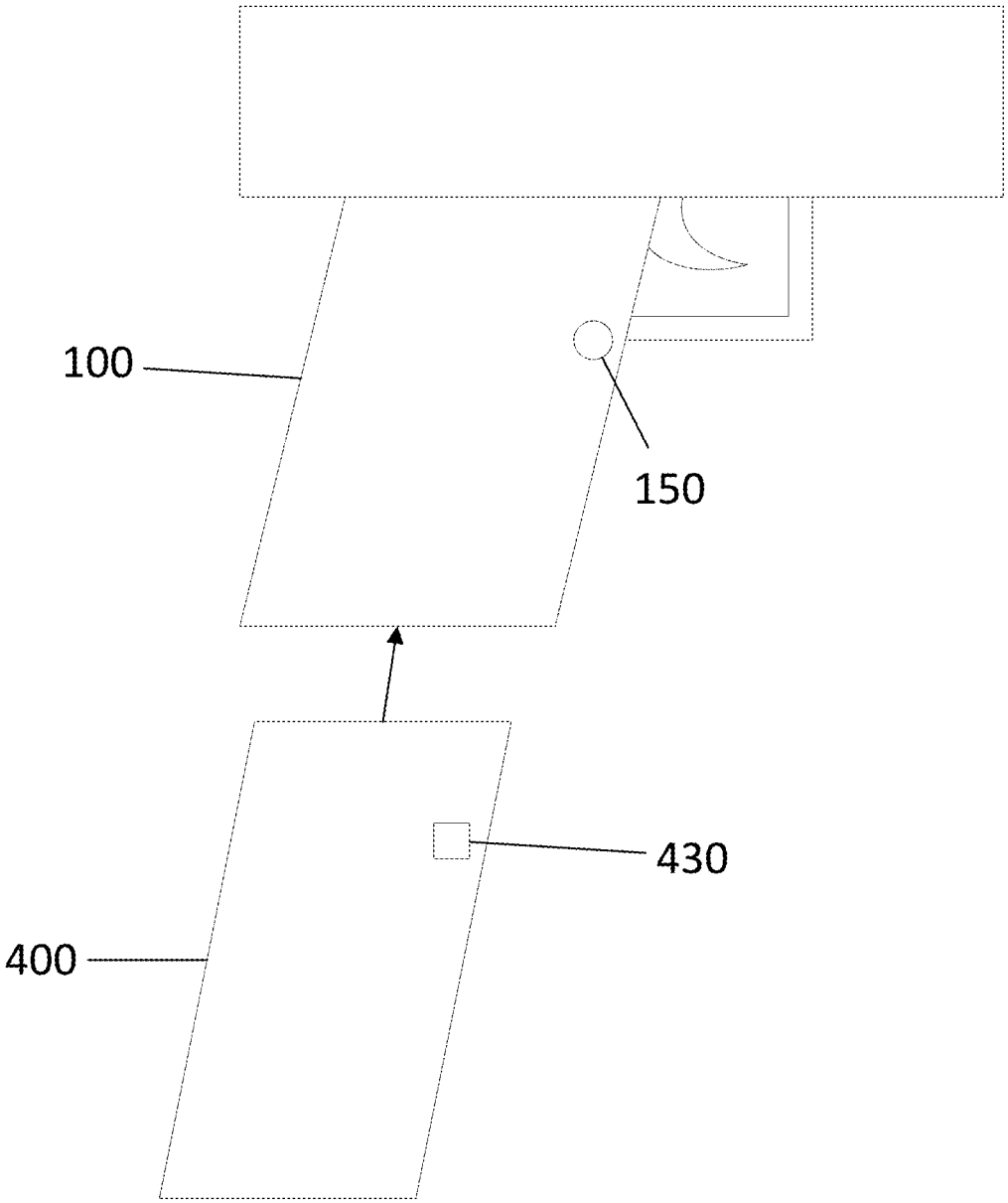
FIG. 14 is a side view of a firearm with an alternative embodiment of the rechargeable cartridge.

In the embodiment illustrated in FIG. 14, the rechargeable cartridge 400 is configured as a magazine clip for a firearm. In this embodiment the grip body 100 has an internal catch (not shown) and a magazine release button 150. The outer body 406 of the rechargeable cartridge 400 has a lock recess 430 which engages the internal catch to hold the rechargeable cartridge 400 within the grip body 100.

In other embodiments, the rechargeable cartridge 400 may be combined with a standard firearm magazine so that the rechargeable cartridge 400 contains a spring-loaded receptacle for housing and delivering rounds of ammunition directly from the rechargeable cartridge 400 into the firearm receiver 200.

A user can use utilize the invention on any firearm receiver 200 structured to receive a pistol style grip. To replace, a person removes the original factory installed grip. Then the person places the grip body 100 on the firearm receiver 200. The person then securely attaches the grip body 100 to the firearm receiver 200 by means of the grip mount bolt 115. The person screws the grip mount bolt 115 through the mount bolt hole 135 in the grip body 100. It is anticipated that the heated grip body 100 may be attached to any type of firearm, including but not limited to pistols, shotguns, assault rifles, and paintball guns.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. A heated firearm grip comprising a grip body said grip body having a hollow internal cavity; said grip body shaped as a firearm pistol grip; a rechargeable cartridge comprising a power source;

an electrically resistive heating element electrically connected to said power source;

wherein said electrically resistive heating element is disposed around said power source;

wherein said rechargeable cartridge is configured to be connected to a recharging station to recharge said power source;

wherein said rechargeable cartridge is configured to be removably secured within said hollow internal cavity of said grip body;

wherein said grip body is interchangeable with the factory installed grip of a firearm.

2. The heated firearm grip as in claim 1 further comprising a level switch disposed on said rechargeable cartridge, said level switch regulating the amperage of electricity flowing from the power source and through said electrically restrictive heating element, said level switch having a plurality of positions.

3. The heated firearm grip as in claim 1 further comprising a power switch disposed on said rechargeable cartridge.

4. The heated firearm grip as in claim 1 wherein said rechargeable cartridge further comprises a rigid shaped outer body.

5. The heated firearm grip as in claim 4 wherein said outer body of said rechargeable cartridge has a lock recess, wherein said grip body further comprises a magazine release button, wherein said rechargeable cartridge is released from said inner cavity of said grip body when said magazine release button is pressed.

6. The heated firearm grip as in claim 5 further comprising a level switch disposed on said rechargeable cartridge, said level switch regulating the amperage of electricity flowing from the power source and through said electrically restrictive heating element, said level switch having a plurality of positions.

7. The heated firearm grip as in claim 6 further comprising a power switch disposed on said rechargeable cartridge.

8. The heated firearm grip as in claim 7 wherein said rechargeable cartridge further comprises a filler material.

9. The heated firearm grip as in claim 1 wherein said rechargeable cartridge further comprises a filler material.

10. A system for heating a handgrip of a firearm comprising a grip body said grip body having a hollow internal cavity; said grip body shaped as a firearm pistol grip; one or more rechargeable cartridges, each rechargeable cartridge comprising a power source;

an electrically resistive heating element electrically connected to said power source;

wherein said electrically resistive heating element is disposed around said power source;

one or more charging stations, each one or more charging stations comprising a power cord and one or more battery receivers;

wherein a rechargeable cartridge is configured to be connected to a battery receiver on a recharging station to recharge said power source;

wherein each of said one or more rechargeable cartridges is configured to removably secured within said hollow internal cavity of said grip body;

wherein said grip body is interchangeable with the factory installed grip of a firearm.

11. The system as in claim 10 wherein said charging station further comprises a pair of electrical connection points in each of said battery receivers;

wherein each of said rechargeable cartridges further comprise a pair of electrical connection points.

12. The system as in claim 11 wherein each of said one or more rechargeable cartridges further comprises a rigid shaped outer body.

13. The system as in claim 12 wherein said outer body of said one or more rechargeable cartridges has a lock recess, wherein said grip body further comprises a magazine release button, wherein a rechargeable cartridge is released from said inner cavity of said grip body when said magazine release button is pressed.

14. The system as in claim 13 further comprising a level switch disposed on each of said one or more rechargeable cartridges, said level switch regulating the amperage of electricity flowing from the power source and through said electrically restrictive heating element, said level switch having a plurality of positions.

15. The heated firearm grip as in claim 14 further comprising a power switch disposed on each of said one or more rechargeable cartridges.

16. A firearm having a heated grip comprising a grip body said grip body having a hollow internal cavity; said grip body shaped as a firearm pistol grip; a grip mount bolt wherein said grip mount bolt passes through said hollow internal cavity of said grip body to removably secure said grip body to said firearm; a rechargeable cartridge comprising a power source;

an electrically resistive heating element electrically connected to said power source;

wherein said electrically resistive heating element is disposed around said power source;

wherein said rechargeable cartridge is configured to be connected to a recharging station to recharge said power source;

wherein said rechargeable cartridge is configured to be removably secured within said hollow internal cavity of said grip body.

17. The firearm as in claim 16 wherein said firearm is a paintball gun.

18. The firearm as in claim 16 wherein said firearm is a semiautomatic rifle.

19. The system as in claim 16 wherein said rechargeable cartridge further comprises a rigid shaped outer body.

20. The system as in claim 19 wherein said outer body of said rechargeable cartridge has a lock recess, wherein said grip body further comprises a magazine release button, wherein said rechargeable cartridge is released from said inner cavity of said grip body when said magazine release button is pressed.

* * * * *